US007331560B2

(12) United States Patent
Jessop et al.

(10) Patent No.: US 7,331,560 B2
(45) Date of Patent: Feb. 19, 2008

(54) CONCRETE FORM SYSTEMS

(75) Inventors: L. Alma Jessop, Herriman, UT (US); Derrel L. Spencer, Lehi, UT (US)

(73) Assignee: Cactus Holdings, LLC, Lehi, UT (US)

( * ) Notice: Subject to any disclaimer, the term of this patent is extended or adjusted under 35 U.S.C. 154(b) by 120 days.

(21) Appl. No.: 10/765,371

(22) Filed: Jan. 27, 2004

(65) Prior Publication Data

US 2006/0071142 A1 Apr. 6, 2006

Related U.S. Application Data

(60) Provisional application No. 60/442,985, filed on Jan. 28, 2003.

(51) Int. Cl.
*E04G 11/08* (2006.01)

(52) U.S. Cl. ..... 249/34; 249/5; 249/6

(58) Field of Classification Search ..... 249/34, 249/3, 4, 5, 6, 9, 208, 213, 218, 47, 191, 249/192, 196, 2, 7; 220/4.29, 4.33, 4.34
See application file for complete search history.

(56) References Cited

U.S. PATENT DOCUMENTS

| | | | | | |
|---|---|---|---|---|---|
| 965,979 | A | * | 8/1910 | Young | 249/2 |
| 1,202,269 | A | * | 10/1916 | Cramer | 249/6 |
| 1,212,654 | A | | 1/1917 | McKay | |
| 1,235,542 | A | * | 8/1917 | Bagby | 249/47 |
| 1,496,933 | A | * | 6/1924 | Heltzel | 249/4 |
| 1,512,165 | A | * | 10/1924 | Funkhouser | 249/6 |
| 1,523,961 | A | * | 1/1925 | Heltzel | 249/6 |
| 1,548,038 | A | * | 8/1925 | Hotchkiss | 249/6 |
| 1,644,588 | A | * | 10/1927 | Heltzel | 249/9 |
| 1,754,638 | A | | 4/1930 | Mead | |
| 2,046,123 | A | * | 6/1936 | Jennings | 249/191 |
| 2,521,279 | A | * | 9/1950 | Becker | 220/4.34 |
| 2,849,780 | A | * | 9/1958 | Hillberg | 249/191 |
| 2,887,756 | A | * | 5/1959 | Brechel | 249/6 |
| 2,919,045 | A | * | 12/1959 | Waugh et al. | 220/4.34 |
| 3,250,421 | A | * | 5/1966 | Braun | 220/4.34 |
| 3,405,835 | A | * | 10/1968 | Eby | 220/4.34 |
| 3,429,547 | A | * | 2/1969 | Schimmel | 249/47 |
| 3,648,962 | A | | 3/1972 | Farley | |
| 3,712,576 | A | | 1/1973 | Dagiel | |
| 4,121,804 | A | * | 10/1978 | O'Leary | 249/6 |
| 4,320,888 | A | * | 3/1982 | Oury | 249/191 |
| 4,442,644 | A | | 4/1984 | Jukes | |
| 4,451,022 | A | * | 5/1984 | Sauger | 249/4 |
| 4,545,163 | A | | 10/1985 | Asselin | |
| 4,579,312 | A | * | 4/1986 | White | 249/6 |

(Continued)

*Primary Examiner*—Michael Safavi
(74) *Attorney, Agent, or Firm*—Morriss O'Bryant Compagni

(57) ABSTRACT

A system for holding poured concrete in a desired shape until it sets is disclosed. The system can include a plurality of forms having two opposing end sections. Each of the end sections has an end bracket attached to it. A plurality of footing stakes are used to connect the end brackets together such that the forms maintain the desired shape. At least one whaler bracket is secured to a top of the forms to maintain the spacing between them. A skin panel can be used to bridge gaps between forms. Bulkhead brackets can be attached to the ends of the forms and secured to allow end walls to be created where desired. Vertical footing panels can also be used to pour concrete onto adjoining inclined surfaces.

12 Claims, 5 Drawing Sheets

U.S. PATENT DOCUMENTS 4,659,054 A * 4/1987 Allen ..... 249/7
4,750,703 A * 6/1988 Gentilcore et al. ..... 249/6
4,829,977 A * 5/1989 Valentine ..... 220/4.34
4,846,437 A 7/1989 Fitzgerald
5,076,536 A 12/1991 Fitzgerald
5,096,155 A 3/1992 Fitzgerald
5,205,942 A 4/1993 Fitzgerald
5,207,931 A * 5/1993 Porter ..... 249/213
5,240,224 A 8/1993 Adams
5,261,635 A * 11/1993 Flathau ..... 249/7
5,332,191 A * 7/1994 Nolan ..... 249/1
5,490,604 A * 2/1996 Alexander ..... 220/4.34
5,535,565 A 7/1996 Majnaric et al.
5,562,272 A 10/1996 McAbee et al.
5,616,271 A 4/1997 Podgurski
5,651,910 A * 7/1997 Myers et al. ..... 249/191
5,833,872 A 11/1998 De Le fever
5,861,105 A 1/1999 Martineau
5,997,792 A 12/1999 Gordon
6,021,994 A 2/2000 Shartzer, Jr.
6,164,615 A 12/2000 Basham
6,175,462 B1 1/2001 Chung et al.
6,250,033 B1 6/2001 Zelinsky
6,322,047 B1 11/2001 Holmboe, Jr.
6,550,213 B1 * 4/2003 Butler ..... 249/47
6,568,651 B2 5/2003 Reid
6,742,758 B2 * 6/2004 Janesky ..... 249/7
2004/0094689 A1 * 5/2004 Rose ..... 249/6

* cited by examiner

CONCRETE FORM SYSTEMS

CROSS-REFERENCE TO RELATED APPLICATIONS

This application claims priority to and the benefit of U.S. Provisional Patent Application Ser. No. 60/422,985, filed on Jan. 28, 2003 and entitled "EZ-FOOTING FORM SYSTEM", which is incorporated by reference in its entirety.

BACKGROUND OF THE INVENTION

1. Field of the Invention

The present invention generally relates to concrete form systems, and, more specifically, to concrete form systems with modular components that can be used to construct various types, sites, and shapes of concrete structures, such as concrete footings.

2. Description of Related Technology

Concrete footings are routinely poured all over the world. These footings provide a solid, secure base on which to build walls or other structures. In the United States, concrete footings are poured for nearly every new home or office building at is points where the weight of the building rests. For new homes, footings are generally poured around the perimeter of the building to provide support for the foundation walls, as well as inside the perimeter to support structural columns or posts.

In the past, conventional concrete footings were often constructed by nailing together plywood or other materials into a form with a desired shape and pouring the concrete into the space created by the plywood. After the concrete is cured, the plywood is separated from the concrete, typically using a hammer. This often results in cracking and splintering of the plywood, thus making the plywood unusable creating new footings. This not only wastes material, but can be a safety hazard because splintered wood can cause injury to the unwary.

Some existing systems have attempted to overcome these drawbacks. For example, one system can include numerous panels with complex grooves or channels connected to the ends of each panel. The channels are designed to allow adjacent panels to interlock, which allows a form to be constructed. This known system requires that complex shaped inserts be placed within the channels to connect the panels. In particular, a first insert could be used to fix adjacent panels into a generally parallel configuration. Another type of insert may be used to fix adjacent panels into a perpendicular configuration.

Unfortunately, this known system also has several drawbacks. For example, the channels are difficult to manufacture because they have a complex structure. In addition, due to the complex structure of the channels, mud or other debris can easily clog the channel which makes it difficult or impossible to use the inserts. Further, if channels in adjacent forms are not precisely aligned, the inserts can be difficult or impossible to use. This is particularly true for the inserts used to join two forms at an angle.

Additionally, because the panels have a predetermined length, it is difficult to design a footing system with the exact dimensions that a user would want. Accordingly, it may be necessary to modify one or more panels to create a form with the desired size and configuration. This undesirably increases the time and cost required to construct the footing.

Finally, this conventional system requires the use of multiple different inserts to enable a user to place the panels at different angular orientations. Thus, it is necessary to identify the inserts needed prior to creating the form. Additionally, any changes in the design of the form require additional time while more panels and/or inserts are obtained, which also increases the costs.

BRIEF SUMMARY OF THE INVENTION

A need therefore exists for a concrete system that eliminates the above-mentioned disadvantages and problems. The present invention is generally directed towards a system that allows concrete structures, such as a concrete footing, to be constructed. Advantageously, the system may facilitate quick and easy assembly of one or more forms to define a space that receives concrete or another material to create the desired structure. The system may be designed so that two or more forms may be easily joined together using simple components that allow the relative position of adjacent forms to be quickly and easily changed using the same brackets and stakes.

One aspect is a system that may include a number of different types of forms and each form may include a bracket attached to each of the opposing ends of the form. The brackets desirably enable the relative position of adjacent forms to be fixed in a desired position.

Another aspect is a system that may include a number of forms of varying lengths. In particular, the forms may have different lengths and brackets may be attached to opposing ends of the form. In addition, a bulkhead form can be attached to another form at a suitable location, such as the brackets attached to the ends of the form or at any desired location along a length of the form. This allows the length of a form to be easily and simply changed to accommodate for different footing or structure configurations.

Still another aspect is a system that may use a skin panel to bridge a gap between forms. Advantageously this allows the length or size of the concrete structure to be expanded and/or extended. In addition, when brackets of adjacent forms do not align, the skin panels may bridge the gap between the separated forms. Using the skin panels, footing or structures of any length can be laid out, even when using forms of fixed length. Desirably, the skin panels fit over the top of the adjacent forms. The skin panels may also have holes in the top to accommodate one or more stakes, which can be inserted through the skin panels and the holes in the brackets attached to the ends of the form.

Yet another aspect is a system that allows the forms to be reused. Advantageously, this eliminates much of the waste associated with conventional forms and systems.

Advantageously, the system may include various types of forms that link together in a easily modifiable manner to accommodate for changes in the layout of a footing or other structure. In particular, the system may simply and easily define a space that receives concrete or another material. This allows concrete structures, such as footings or other structures to be quickly and efficiently created.

In one embodiment, the system can include one or more forms that include a panel with two end brackets mounted or attached to opposing ends of the panel. The end brackets may include a flange configured to fit around and be attached to the ends of the panels. The end brackets may also include a tubular portion that extends a distance beyond the ends of the panels. A hole may be disposed in the tubular portion to accommodate a stake that can be used to secure the panel and hence the form in place. By selectively placing one form with an end bracket in an upward position, and an adjacent form with an end bracket in a downward position, the forms can be joined together by inserting a stake through the two aligned holes in the end brackets. One advantage of the system is that a user can then join the forms at almost any angle since each form can rotate about an axis defined by the holes in the tubular portions receiving the stake.

In another embodiment, the system can include a form that includes a panel with two bulkhead brackets mounted or attached to the ends of the panel. The bulkhead brackets of this bulkhead form may have a top and bottom extension that extends far enough past the end of the panel to allow the brackets to protrude over the top and under the bottom of the panel of another form. The bulkhead form can be located at any position along the length of other forms using the end brackets, which allows a length of a footing or other structure to be changed by simply moving the location of the bulkhead form. Thus, the length of the footing or other structure is not limited by the length of the forms. In addition, the bulkhead brackets may also have holes to accommodate stakes to allow the bulkhead form to be secured in a desired location.

The system may also allow concrete or other material to be poured on an inclined surface. In particular, the concrete or other material can be poured on an upwardly or downwardly sloping surface. For example, the system may include a pair of vertical forms to aid with accomplishing this task. The pair of vertical forms can be fixed on a top surface of the forms and joined together to hold the poured concrete against the inclined surface. The vertical forms may each have two sides that are joined at approximately 90-degree angle. One of the two sides of each of the pair of the vertical forms may be desirably connected together to form a substantially rectangular channel with the inclined surface forming the fourth side. This allows for the pouring of concrete footers and other structures at varying angles and inclined surfaces.

These and other objects and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE EXEMPLARY EMBODIMENTS

Figure 1:
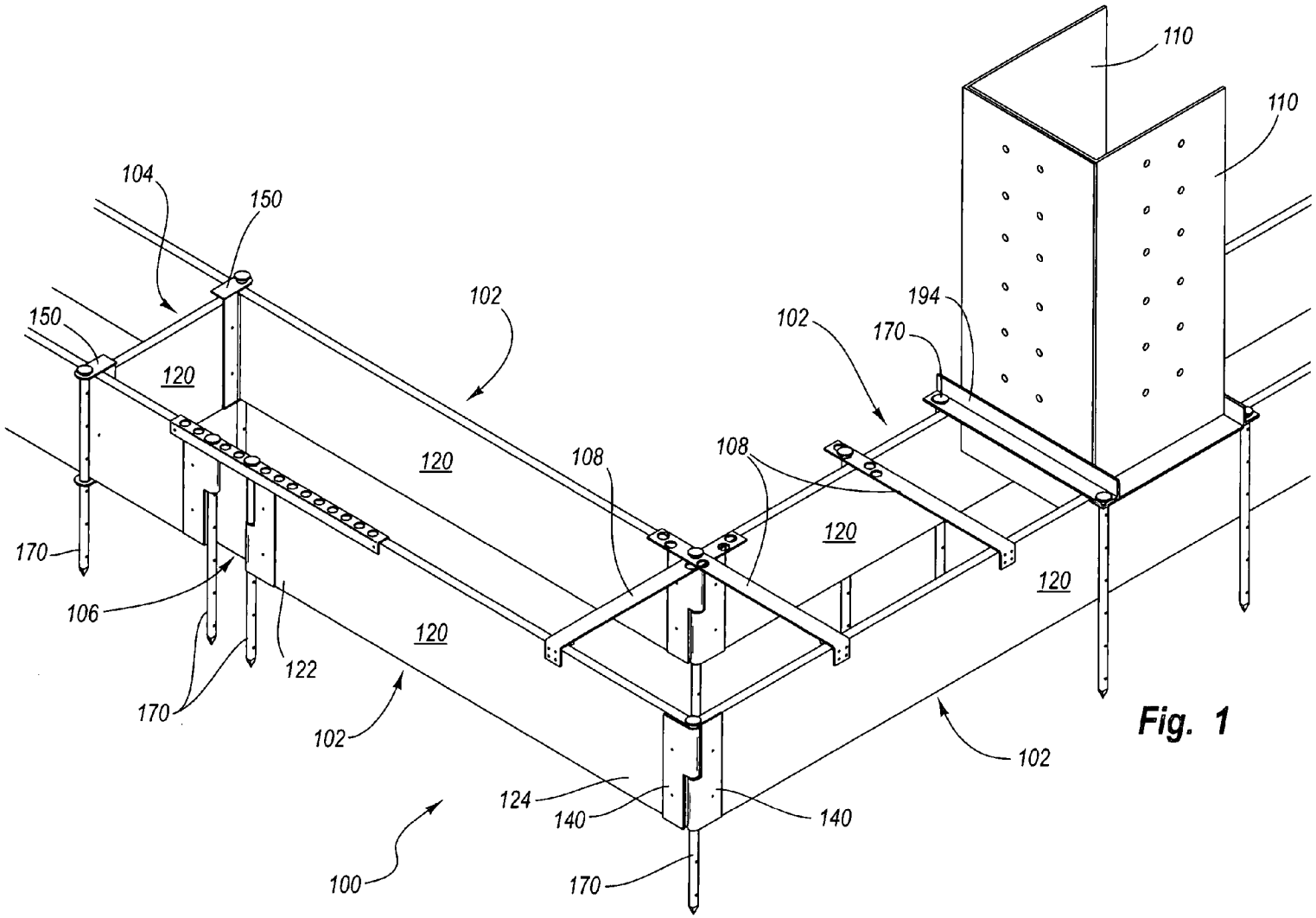
FIG. 1 is a perspective view of an exemplary embodiment of a system used to construct a footing.

The present invention is a system used to create concrete footings or other concrete structures. One exemplary embodiment of an exemplary system is shown in FIG. 1, and designated generally as reference numeral 100. This system 100 enables forms for footings or other concrete structures to be positioned in a simple and efficient manner, and to any desired dimensions, while limiting waste of wood or other materials. The system 100 can include various forms, brackets, and panels that are used together to accommodate variations in footing layout and configuration.

The system 100 generally can include a number of forms, shown generally as reference numerals 102 and 104. As mentioned above, a form is a structure that aids with defining a space within which concrete or other material is to be received. One or more forms are used to create a structure layout of the space to receive the concrete or other material. In the exemplary system 100, various types or kinds of forms are provided, each of which perform different functions and connect to other forms in a different manner. The system 100 facilitates simple joining of forms using simple components that allow the relative position of adjacent forms to be quickly and easily changed.

With reference to FIG. 1, system 100 can include a form 102 and a form 104. Each form 102, 104 may include a panel 120 with a bracket attached to each opposing end of the panel 120. The brackets can be selected based upon the function to be performed by the form. A general purpose form, such as the form 102, can include end brackets 140. In contrast, a bulkhead form 104 may include bulkhead brackets 150. The bulkhead form 104 can be used to ensure that the spaced defined by system 100 has a uniform width. The system 100 may also include a whaler bracket 108 that acts as a brace between two spaced apart forms 102, while maintaining a desired separation between the forms 102.

When using the system 100 to create a space to receive concrete or other material, a lengthwise gap may be left between two adjacent forms 102. This may occur when the end brackets 140 of two adjacent forms 102 do not align. To bridge this gap, the system 100 can include a skin panel 106. The skin panel 106 can accommodate various lengths of gap and so using the skin panels 106, footing or structures of any length can be laid out, even when using forms of fixed length.

The exemplary embodiments will be described in the context of using the system 100 for creating a concrete footing for a building structure. It will be understood, however, that the exemplary embodiments can be used with other concrete structures. Generally, the system is modular and can include a variety of forms, panels, and brackets that can connect together to define a desired space that receives concrete or other material.

Figure 2:
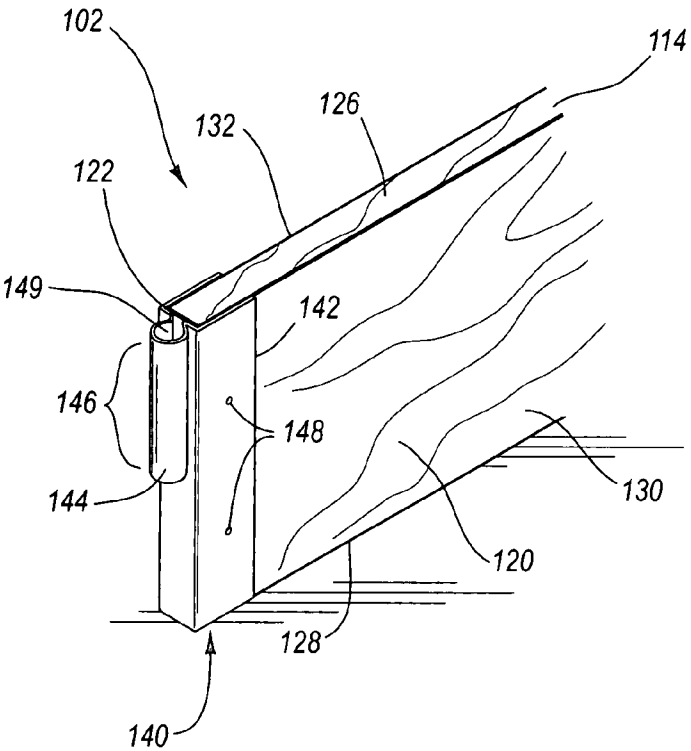
FIG. 2 is a perspective view of a portion of the system shown in FIG. 1, illustrating an end bracket.
Figure 3B:
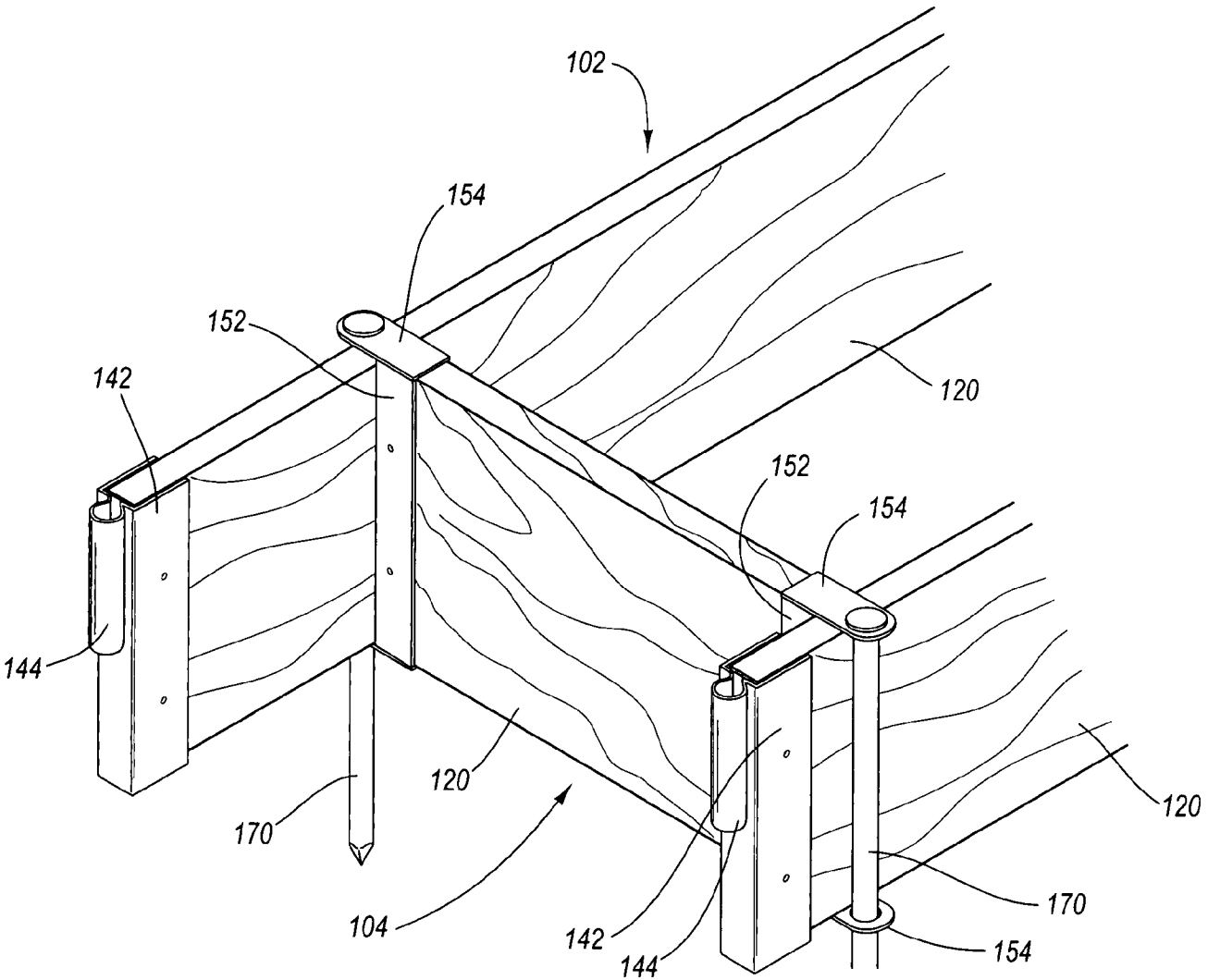
FIG. 3B is perspective view of portion of the system shown in FIG. 3A in one exemplary operational position.

With reference to FIG. 2, the form 102 may include the panel 120 with the end brackets 140 attached to opposing ends of the form 102. In other configuration, the form 102 can include a single end bracket 140. The panel 120 may be generally planar and have sufficient rigidity to hold concrete or other materials in place before it cures. In the illustrated configuration, the panel 120 has a proximal end 122 and a distal end 124 (FIG. 1), each of which can receive the end bracket 140. Extending between the proximal end 122 and the distal end 124 of the panel 120 is a top surface 126, a bottom surface 128, an inside surface 130, and an outside surface 132. These terms are specific to the orientation of form 102 illustrated in FIG. 2. It will be understood that if the form 102 is inverted, the top surface 126 may not be the "top surface", the bottom surface 128 may not be the "bottom surface", the inside surface 130 may be not the "inside surface", and the outside surface 132 may not be the "outside surface". The exemplary embodiments should not be considered limited by the use of these relative terms.

In one exemplary embodiment, each panel 120 is a wooden board, although other materials are possible, such as plywood, plastic, pressboard, metal, alloy, high density overlaid (HDO) wood, composites, or any other material having the desired rigidity and strength. Additionally, each panel 120 can be fabricated from one or more sections that connect together to create the desired structure of panel 120. The panels 120 can have various cross-sectional areas or dimensions. In one configuration, the panel 120 has cross-sectional dimensions of about two inches by about twelve inches. In another configuration, the panel 120 can have cross-sectional dimensions of one and one eighth inches by eleven and one eighth inches, one and one quarter inches by eleven and seven eighth inches, or other cross-sectional dimensions depending on the type of material used to make panels 120. Similarly, each panel 120 can have various lengths, such as but not limited to, from about one foot to about twelve feet in length. It will be understood that lengths lesser than one foot and greater than twelve feet are also possible.

As shown in FIG. 2, the end bracket 140 may mount to the end 122 and may include a flange 142 that has a tubular portion 146. The tubular portion 146 can extend from the top surface 126 of the panel 120 toward the bottom surface 128. To aid with connecting adjacent forms 102, the end bracket 140 mounted to the distal end 124 (FIG. 1) of the panel 120 is inverted. The end bracket 140 at the distal end 124 (FIG. 1) then can include the tubular portion 146 extending from the bottom surface 128 toward the top surface 126. This allows for easy, quick joining of multiple forms in multiple angular orientations.

In another configuration, the system 100 can include one or more forms 102 that include the panel 120 having both end brackets 140 fitted onto the ends 122, 124 in the same orientation. For instance, in one configuration, both end brackets 140 are in an upward position, while in another configuration both end brackets 140 are in a downward position.

With continued reference to FIG. 2, the flange 142 of the end bracket 140 attaches to the end 122. To aid with attaching the flange 142 to the panel 120, the flange 142 may include at least two fastening holes 148. The end bracket 140 attaches to the end 122 of the panel 120 as one or more fasteners pass through the fastening holes 148 and attach to the panel 120. The fastening holes 148 can accommodate any type of mechanical fastener, such as, but not limited to, nails, screws, bolts, rivets, etc. Alternately, or in addition to mechanical fasteners, various types of adhesives or epoxies can be used to attach the end bracket 140 to the panel 120 of the form 102. Further, each bracket 140 can include one or more protruding structures that attach to the panel 120 as the end bracket 140 is attached to the panel 120.

The tubular portion 146 may extend from the top surface 116 towards the bottom surface 128. In the illustrated configuration, the tubular portion 146 extends towards the bottom surface 128 about half the height of the panel 120. In other configurations, the tubular portion 146 can extend towards the bottom surface 128 less or more than about half the height of the panel 120.

The tubular portion 146 may have a hole 149 that receives the stake 170 (FIG. 1). This stake 170 may pass through the holes 149 in adjacent forms when the form 102 having the tubular portion 146 on the bottom is placed end to end with another form 102 that has the tubular portion 146 on top, as shown in FIG. 1. The stake 170 can also be driven into the ground to hold the forms 102 in alignment while the concrete or other material is deposited in the space defined by the system 100.

Returning to FIG. 2, the end brackets 140 allow adjacent forms to be easily joined together and the relative position of adjacent forms to be quickly and easily changed. The end brackets 140 can be made from a wide range of materials, including, but not limited to, various metals or metal alloys, plastics, composites, fiberglass, or other materials having the desired strength and rigidity. In one exemplary embodiment of the system 100, the end brackets 140 are metal, sized and configured to slip easily over the end 122, 124 of the panel 120. The end brackets 140 can optionally have a completely or partially closed end section to fit flush with the ends 122, 124 of the panel 120.

Various other configurations of the end bracket 140 are possible. For instance, in another configuration each tubular portion 146 can have a first portion having a first outside diameter and a second portion having a second outside diameter lesser than the first diameter. The first portion may have an inside diameter that is complementary to the second portion so that a first portion of the end bracket on one form can receive the second portion of the end bracket on an adjacent form. In this manner, adjacent forms interference fit together. Optionally, the stake 170 can pass through the holes 149 of the tubular portions as adjacent forms interference fit together.

In still another configuration, a tubular portion disposed toward the top surface 126 of the panel 120 may include one or more grooves that engage with complementary protrusions fashioned in a tubular portion disposed toward the bottom surface 128 of an adjacent panel 120. The grooves and protrusions engage to lock the orientation of one form 102 relative to another form 102. Depending upon the number of grooves and protrusions one form can be locked relative to another form at any angular orientation. In some configuration, each tubular portion can include a locking screw that passes through one or both of the tubular portions to prevent movement of the forms.

As discussed above, the form 104 can cooperate with the forms 102. With continued reference to FIG. 3A, the form 104 may include the panel 120 having a bulkhead bracket 150 mounted to either end of the panel 120. The form 104 can be disposed between two spaced apart forms 102 to define the end limit of the space that receives the concrete or other material. In the exemplary configuration, the form 104 defines the end of a concrete footing.

Generally, the form 104 can be located at any position along the length of forms 102 to enable the length of a footing or other structure to be changed by simply moving the location of the bulkhead. Thus, the length of the footing or other structure is not limited by the length of the forms. Hence, the bulkhead form 104 in combination with the forms 102 can define any sized space that receives concrete or other materials. The changes in length of the footing, for example, resulting from placing the bulkhead form 104 relative to the form 120 is possible without physically changing the length of each form 102.

Figure 3A:
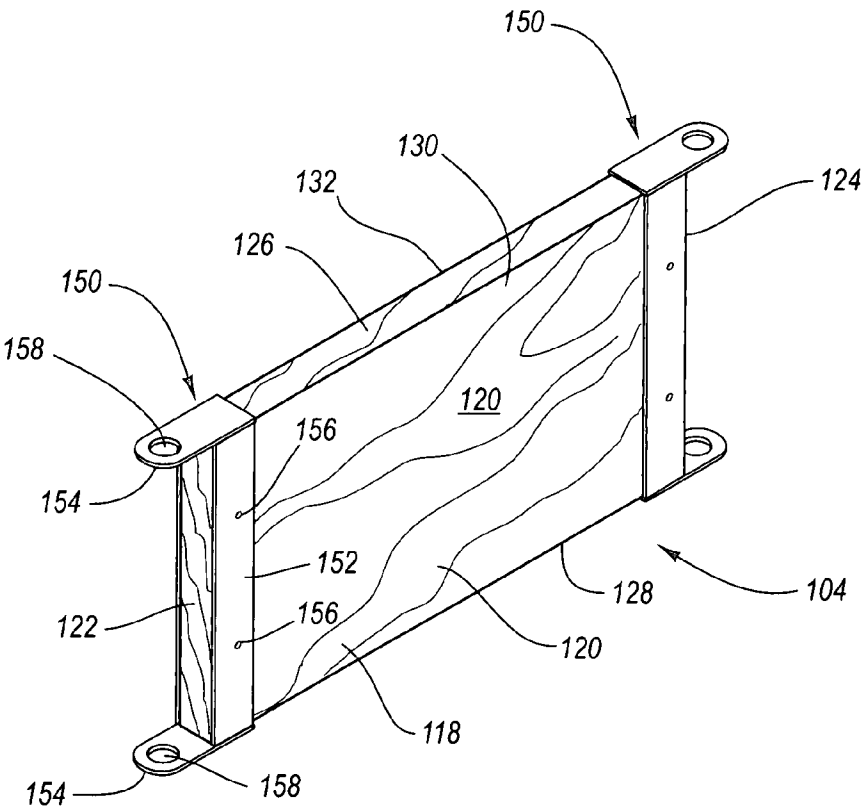
FIG. 3A is a perspective view of a portion of the system shown in FIG. 1, illustrating a bulkhead bracket.

The following discussion is directed to the bulkhead bracket 150 mounted to the end 122. It is understood that a similar discussion can be provided for the bulkhead bracket 150 mounted to the end 124. As shown in FIG. 3A, the bulkhead bracket 150 may have a main body 152 from which extends two flanges 154. The main body 152 can slide over the end 122 and completely or partially enclose the end 122. A portion of the main body 152 can contact one or more of the top surface 126, the bottom surface 128, the inside surface 130, or the outside surface 132. The main body 152 attaches to either the end 122, 124 of the panel 120 using a similar configuration to that of end bracket 140. The bracket 150 can, therefore, include one or more fastener holes 156 that accommodate any type of mechanical fastener, such as, but not limited to, nails, screws, bolts, rivets, etc. Alternately, or in addition to mechanical fasteners, various types of adhesives or epoxies can be used to attach the bulkhead bracket 150 to the panel 120. Further, each bracket 150 can include one or more protruding structures that attach to the panel 120 as the end bracket 150 is attached to the panel 120.

As mentioned above, the flanges 154 may protrude from the main body 152. In one configuration, the flanges 154 are symmetrical, so that the panel 120 with the bulkhead bracket 150 has no top or bottom, although those skilled in the art will realize that this need not be the case. Each flange 154 may contain at least one hole 158 that receives the stake 170, not shown. By placing the holes 158 in the flanges 154 so that the panel 120 can be disposed between a portion of the holes 158 and the main body 152, the form 104 can be disposed between two forms 102. The stakes 170 prevent movement of the bulkhead form 104 longitudinally along the forms 102, while also limiting lateral movement.

When assembling the system 100 a lengthwise gap may be created between adjacent forms 102, as shown in FIG. 1. This occurs because the holes 149 (FIG. 2) in the end brackets 140 do not align. The system 100 can include skin panel 106, as illustrated in FIGS. 4A and 4B, to bridge this gap between the forms.

Figure 4B:
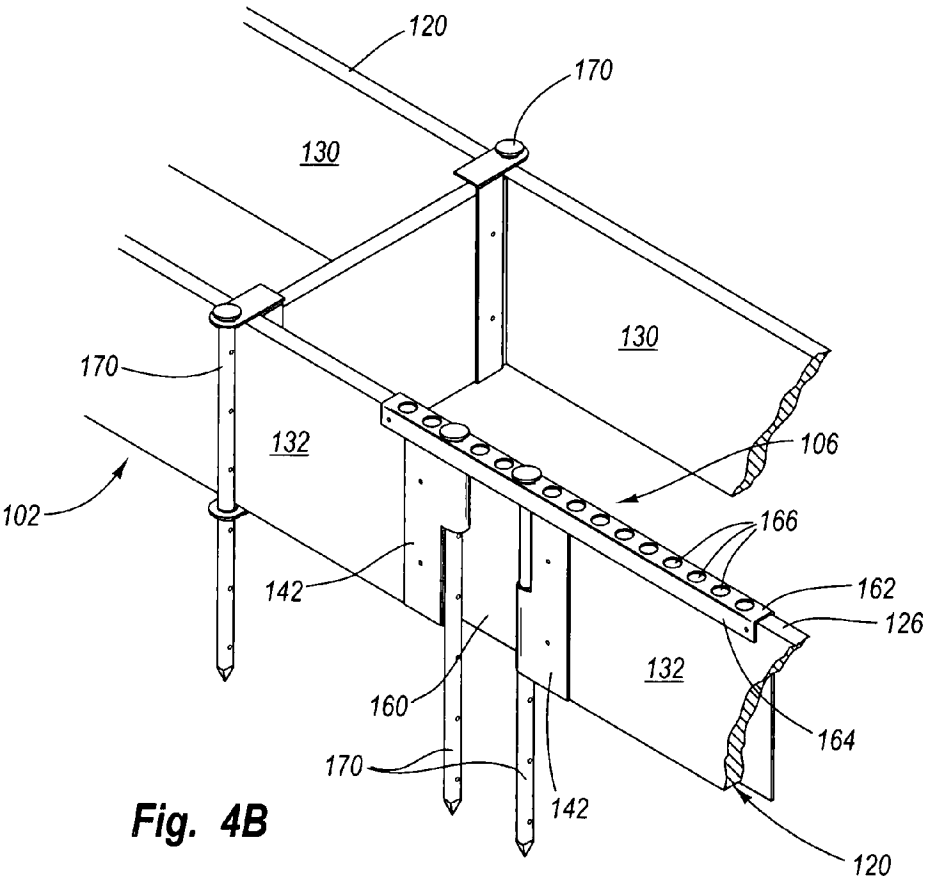
FIG. 4B is a perspective view of the skin panel of FIG. 4A in one exemplary operational position.
Figure 4A:
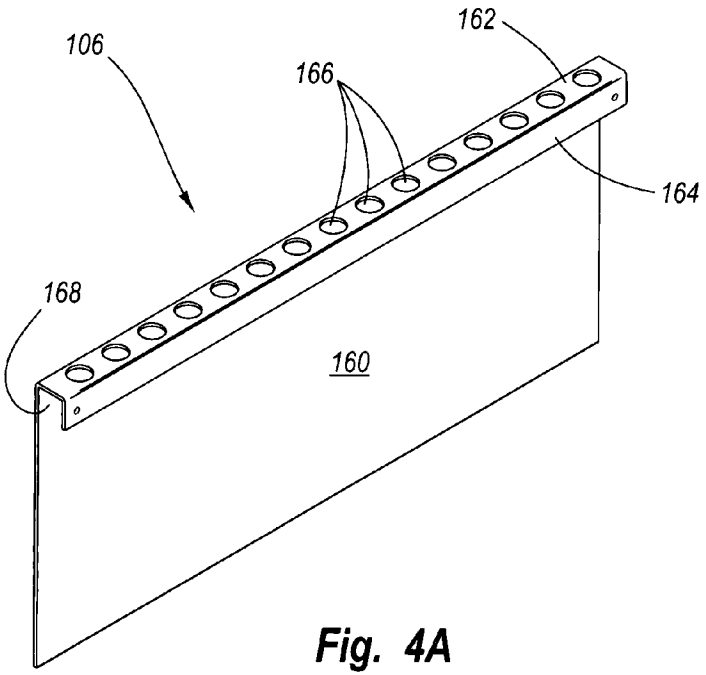
FIG. 4A is a perspective view of a portion of the system shown in FIG. 1, illustrating a skin panel.

With reference to FIG. 4A, the skin panel 106 may have a first portion 160 and a second portion 164 that is separated from the first portion 160 by an intermediate portion 162. The separation between the first portion 160 and the second portion 164 provided by the intermediate portion 162 define a channel 168. This channel 168 may be sufficient to enable placement of the skin panel 106 over at least a portion of two adjacent forms 102. More specifically, the panel 120 can locate within the channel 168 of the skin panel 106.

Generally, the skin panel 106 may be fabricated from a unitary piece of metal or metal alloy. Those skilled in the art will realize that other materials can also be used to form the skin panel 106, such as, but not limited to, plastics, wood and/or wood products, composites, combinations thereof, or other materials having the desired strength and rigidity. Although reference is made to the skin panel 106 being fabricated from a unitary piece of a material, alternate configuration of the present invention can utilize a modular construction where the first portion 160, the second portion 164, and/or the intermediate portion 162 interference fit together through complementary structures in the first portion 160, the second portion 164, and/or the intermediate portion 162. Alternately, the second portion 164, and/or the intermediate portion 162 can fit together, whether alone or through the use of mechanical fasteners, welds, adhesives, or other techniques for joining two or more members.

With reference to FIG. 4B, the first portion 160 of the skin panel 106 may be placed adjacent the inside surface 130 of the panel 120 of the form 102. The channel 168 may receive the panel 120 so that the top surface 126 may contact or be close to the intermediate portion 162. One or more holes 166 in the intermediate portion 162 can receive one or more stakes 170. These stakes 170 pass through the holes 166 and the holes 149 (FIG. 2) when they align. If desired, the stakes 170 can be driven into the ground to secure the forms 102 in place and to provide structural support when concrete or other material is poured into the space defined by the system 100.

In one configuration, the skin panel 106 can be twenty-four inches long. Those skilled in the art will realize that other shorter and longer lengths are possible. Such shorter and longer lengths fall within the scope of the exemplary configuration of the system 100.

As the system 100 is assembled, a whaler bracket 108 may be used to brace spaced-apart forms 102 to ensure a uniform separation between the forms 102. Uniform separation of the forms results in the width of the concrete or material deposited between the forms 102 and 104 being uniform. In one configuration, the whaler bracket 108 is made from angle iron, or other metals or metal alloys. Those skilled in the art will realize that other materials can be used, including plastics, wood and/or wood products, composites, etc.

Figure 5:
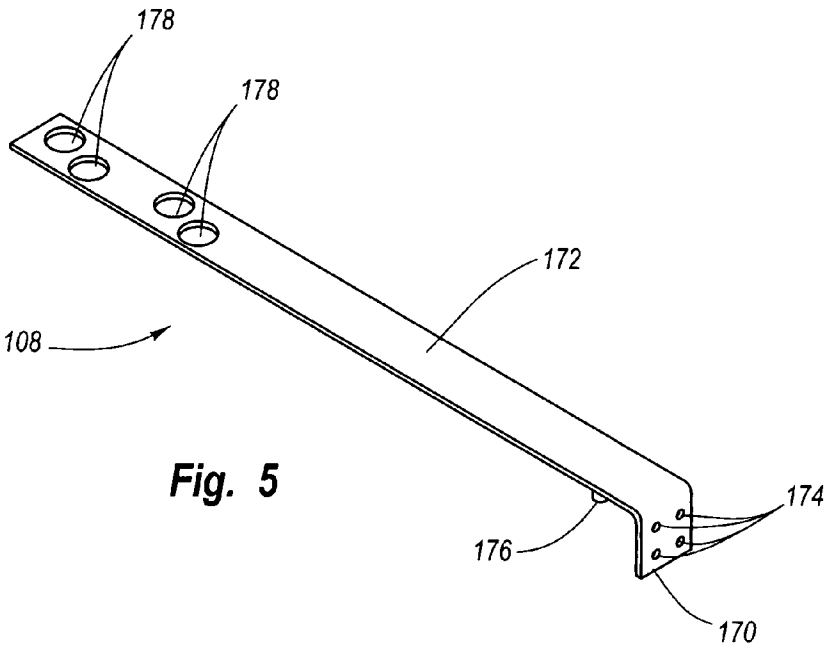
FIG. 5 is a perspective view of a portion of the system shown in FIG. 1, illustrating a whaler bracket.

With reference to FIG. 5, the whaler bracket 108 can have a generally L-shaped configuration, with a first portion 170 and a second portion 172 that is can be generally perpendicular to the first portion 170. Although reference is made to the first portion 170 and the second portion 172 being generally perpendicular one to another, one skilled in the art will understand that other angular orientations of first portion 170 to second portion 172 are possible. Similarly, even though reference is made to the whaler bracket 108 being generally L-shaped, one in the art will understand that other configurations of the whaler bracket 108 are possible. For instance, the whaler bracket 108 can be J-shaped, planer, curved, polygonal, or any other shape.

Disposed in the first portion 170 of the whaler bracket 108 are fastener holes 174 that can accommodate any type of mechanical fastener, such as, but not limited to, nails, screws, bolts, rivets, etc. Extending from the second portion 172, in the same direction as the first portion 170, is a blocking pin 176. This blocking pin 176 contacts the inside surface 130 (FIG. 2) of the panel 120 to assist in fixing the whaler bracket 108 in place. It is understood, however, that other configurations of the whaler bracket 108 need not include the blocking pin 176.

In addition to the exemplary configuration of the whaler bracket 108 including the blocking pin 176 on the second portion 172, one or more stake holes 178 can be located through the second portion 172. Multiple stake holes 178 allow the whaler bracket 108 to be placed at various positions to ensure uniform spacing of spaced apart forms 102.

Figure 6:
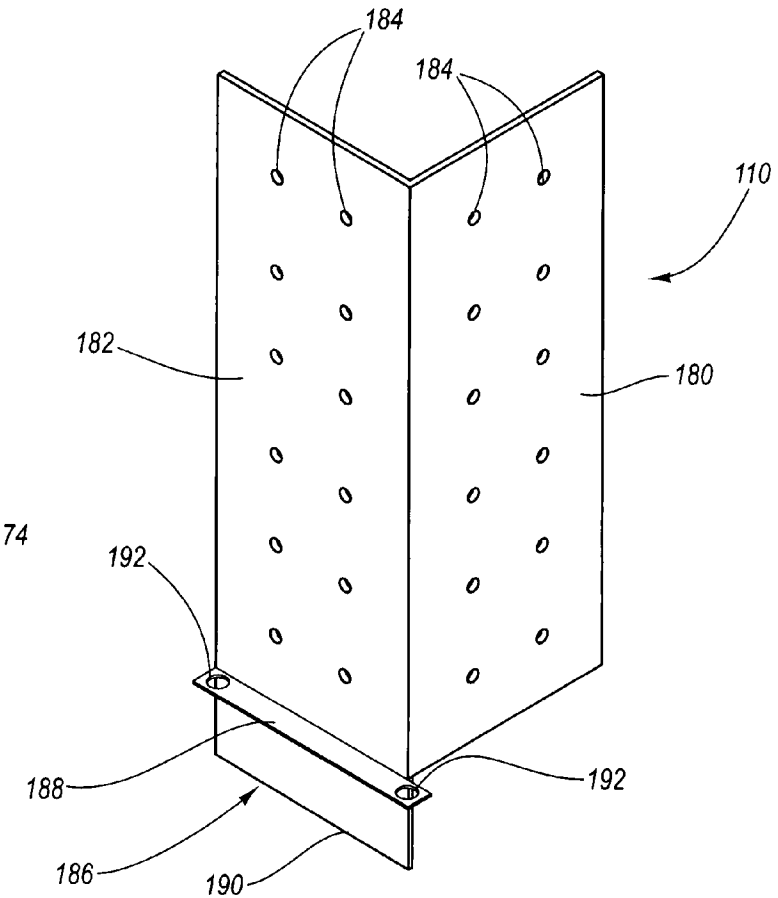
FIG. 6 is a perspective view of a portion of the system shown in FIG. 1, illustrating a vertical form.

It is occasionally desired to pour vertical or angled concrete structures, such as footings, as well as horizontal footings or structures. Such a need arises, for example, when the footings need to conform to ground that is uneven. The system 100 may accommodate this need with a vertical panel 110, as shown in FIG. 6. In one configuration, the vertical panel 110 is fabricated from metal or metal alloys. Those skilled in the art will realize that other materials are also possible, including, but not limited to, plastics, wood and wood products, composite materials, or other materials having the desired strength and rigidity.

With reference to FIG. 6, a single vertical panel 110 is shown. However, with reference to FIG. 1, the vertical panel 110 can be used as a pair of panels that form three or four closed sides, with a fifth side being the uneven ground discussed above and the sixth side being open to receive the concrete or other material poured into the spaced defined by the two vertical panels 110. The vertical panel 110 can include a first panel member 180 and a second panel member 182. The panel members 180 and 182 are disposed generally perpendicular one to another. Although reference is made to first the panel member 180 and the second panel member 182 being generally perpendicular one to another, one skilled in the art will understand that other angular orientations of the first panel member 180 to the second panel member 182 are possible.

Disposed in the first panel member 180 and the second panel member 182 is a plurality of fastener holes 184. The fastener holes 184 can accommodate any type of mechanical fastener, such as, but not limited to, nails, screws, bolts, rivets, etc. The fastener holes 184 allow additional structural reinforcements to be attached to the vertical panel 110, such as when the vertical panel 110 is used to abut uneven ground at an angle. These additional reinforcements can be attached on either an inside or an outside surface of the vertical panel 110 and can be fabricated from wood, plastic, metal, composites, or any other suitable material that provides the desired reinforcement properties or characteristics.

In the exemplary configuration of the vertical panel 110 shown in FIG. 6, the panel 110 can include a mounting member 186 attached to the second panel member 182, however the mounting member 186 can optionally attached to the first panel member 180. This mounting member 186 can include a stop 188 and a positioning member 190. The stop 188 can include a plurality of holes 192 that can receive the stakes 170 (FIG. 1). The stop 188, of one of the vertical panels illustrated in FIG. 1, contacts a portion of the form 102 to both support the vertical panel 110 and prevent the vertical panel 110 from moving toward the bottom surface of the form 102. Another one of the vertical panels illustrated in FIG. 1 contacts a portion of another one of the forms 102. In both cases, the stop 188 can rest upon top surface 126 (FIG. 1) of panel 120. Similarly, the positioning member 190 of each vertical panel abuts one of the vertical surfaces of the form 102 or 104, and more specifically the panel 120, to prevent the vertical panel 110 from shifting when the concrete or other material is deposited into the space define by the forms and panels. To aid with preventing movement of the vertical panel 110, the stakes 170 pass through the holes 192 and through holes formed in optionally tie 194, which extends between the two vertical panels 110, to be driven into the ground or surface upon which the system 100 is disposed. This tie 194 also partially extends along a surface of vertical panels 110 prevent movement of the vertical panels 110 during pouring or depositing of the concrete or other material deposited into the space defined by the vertical panels 110 and other forms or panels of system 100.

Generally, the vertical panel 110, with the panel members 180, 182 and the mounting member 186 can be fabricated from a unitary piece of a material or from multiple pieces attached or joined together. Attaching or joining multiple pieces of material can occur through use of mechanical fasteners, welds, adhesives, or other techniques for joining two or more members together. In this configuration, the vertical panel 110 is made from metal, however, the vertical panel 110 can be fabricated from wood, plastic, metal, allow, composites, or any other suitable material that provides the desired strength and rigidity.

Returning to FIG. 1, in an exemplary configuration, the stakes 170 can be made from metal, and be about 0.75 inches in diameter. The stakes 170 can be of a sufficient length to be easily driven into the ground through holes in the various components discussed above. This provides for additional support when the concrete is poured into the forms. Those skilled in the art will realize that other materials, diameters, and varying lengths for the stake 170 are also possible. For example, the stake 170 can be made from plastic, wood, composites, or other suitable materials.

The system 100 provides many advantages over the prior art. The system 100 eliminates the old way of nailing boards together, which causes weak corners, extreme wear, and splintering of the lumber. Both the end brackets 140 and the bulkhead brackets 150 fit at least partially over the exposed ends of the panels 120 of the forms 110, thus eliminating the cracking, splitting and splintering caused by nailing, while increasing the life of the forms by many times that of conventional lumber forms. The system 100 also eliminates the wasting of expensive nails and lumber, since the forms can be reused.

The system 100 allows the connection of two forms 110 with a steel pin or stake. Once pinned together, the system 100 allows forms to be connected together in a straight line, ninety-degree inside and outside corners, and any corner or angle in between. This is a great improvement over prior art systems that use channels and inserts, since these prior art systems can only be joined at angles of about 90 degrees.

Using the skin panel 106, the system can define a space to receive concrete or other materials of any desired dimension, regardless of the specific length of the individual forms. Any gaps between the forms 102 are bridged with the skin panel 106. Finally, the system 100 using the form 104 allows the end of the space that receives the concrete or other material to be placed anywhere inside the spaced apart forms 102. This allows for a system 100 that can include a fixed number of forms each having a fixed length, yet still accommodates a space of any required dimension.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A system for holding poured material in a desired shape until the concrete sets, the system comprising:

a plurality of forms, each said form having a panel with a first end, a second end, and a first surface and a second surface extending between said first end and said second end, and two end brackets, a first end bracket attached to said first end and a second end bracket attached to said second end, each of said first end bracket and said second end bracket comprising a flange mounted to said panel and a tubular portion extending from said flange, said tubular portion of said first end bracket extending from said first surface toward said second surface and terminating distal to said second surface and said tubular portion of said second end bracket extending from said second surface toward said first surface;

a plurality of stakes slidably cooperating with said plurality of forms, one stake of said plurality of stakes slidably cooperating with two adjacently positioned forms of said plurality of forms when said hole of said first end bracket of one form of said plurality of forms aligns with said hole of said second end bracket of another form of said plurality of forms;

at least one skin panel mounted between two spaced apart forms of said plurality of forms, wherein said skin panel comprises a first portion separated from a second portion by an intermediate portion, said first portion and said second portion extending form said intermediate portion in the same direction and forming a channel that receives a portion of said at least two forms; and at least one bracket secured to a top of one or more of said forms to maintain a spacing between spaced apart and parallel forms of said plurality of forms.

2. The system of claim 1, further comprising at least one bulkhead form mountable between two of said plurality of forms that are spaced apart one from another, said at least one bulkhead form maintaining a spacing between said two forms.

3. The system as recited in claim 2, wherein said at least one bulkhead form comprises:

a panel comprising a first panel end, a second panel end, and a first panel surface and a second panel surface extending between said first panel end and said second panel end; and two bulkhead brackets mounted to said panel, each said bulkhead bracket comprising a first flange extending from said panel and a second flange extending from said panel, one of said plurality of forms being disposed between said first flange and said second flange.

4. The system as recited in claim 3, wherein said first flange and said second flange each further comprise a hole, said hole receiving one of said plurality of stakes to prevent movement of said at least one bulkhead bracket relative to said plurality of forms.

5. The system as recited in claim 1, wherein each said panel is fabricated from a material selected from a group consisting of a natural material, a synthetic material, a metallic material, a composite material, or a metallic alloy.

6. A system for holding poured material in a desired shape until the concrete sets, the system comprising:

a plurality of forms, each said form having a panel with a first end and a second end and a first end bracket mounted to the first end and a second end bracket mounted to the second end, each said end bracket comprising a flange mounted to said panel and a stake receiving portion, said stake receiving portion of said first end bracket extending from a top portion of said panel toward a bottom portion and said stake receiving portion of said second end bracket extending from said bottom portion toward said top portion;

a plurality of stakes slidably cooperating with said plurality of forms, one stake of said plurality of stakes slidably cooperating with two adjacently positioned forms of said plurality of forms when said hole of said first end bracket of one form of said plurality of forms aligns with said hole of said second end bracket of another form of said plurality of forms;

a pair of vertical panels, each said vertical panel being fixed on a top surface of said at least one of said plurality of forms;

at least one bracket secured to a top of one or more of said forms to maintain a spacing between spaced apart and parallel forms of said plurality of forms; and at least one bulkhead form mounted to two spaced apart forms of said plurality of forms.

7. The system as recited in claim 6, further comprising at least one skin panel mountable to two of said plurality of forms.

8. The system as recited in claim 7, wherein said at least one skin panel comprises a first portion separated from a second portion by an intermediate portion, said first portion and said second portion extending from said intermediate portion in the same direction and forming a channel that receives a portion of said at least two forms.

9. The system recited in claim 8, wherein said first portion and said second portion have the same length.

10. The system recited in claim 8, wherein said intermediate portion further comprises a plurality of stake receiving holes.

11. The system as recited in claim 10, wherein one of said plurality of stakes passes through at least one of said plurality of holes in said intermediate portion and said hole in said end bracket, said stake being driven into a portion of ground to secure said system in place.

12. The system as recited in claim 6, wherein each said vertical panel further comprises a mounting member that prevents vertical movement of said vertical panel relative to at least one of said plurality of forms.

* * * * *